US005941708A

United States Patent [19]

FitzGerald

[11] Patent Number: 5,941,708

[45] Date of Patent: Aug. 24, 1999

[54] METHOD FOR SIMULATING TEMPORAL ASPECTS OF AREA WEAPONS

[75] Inventor: Mark Richard FitzGerald, Phoenix, Ariz.

[73] Assignee: Motorola, Inc., Schaumburg, Ill.

[21] Appl. No.: 08/653,537

[22] Filed: May 24, 1996

[51] Int. Cl.[6] ..... B64D 1/00

[52] U.S. Cl. ..... 434/16; 434/11; 434/19

[58] Field of Search ..... 434/11, 14–17, 434/19, 20–23, 27; 342/357, 386, 387; 102/401–407

[56] References Cited

U.S. PATENT DOCUMENTS

| | | | |
|---|---|---|---|
| 4,682,953 | 7/1987 | Doerfel et al. . | |
| 4,744,761 | 5/1988 | Doerfel et al. . | |
| 4,976,619 | 12/1990 | Carlson . | |
| 5,292,254 | 3/1994 | Miller et al. | 434/11 |
| 5,382,958 | 1/1995 | Fitzgerald | 434/23 |
| 5,447,436 | 9/1995 | Campagnuolo et al. | 434/11 |
| 5,537,909 | 7/1996 | Schneider et al. | 89/1.11 |
| 5,571,018 | 11/1996 | Fitzgerald | 434/11 |

*Primary Examiner*—Richard J. Apley
*Assistant Examiner*—Glenn E. Richman
*Attorney, Agent, or Firm*—Frank J. Bogacz

[57] ABSTRACT

A method simulates the time effect of a battlefield engagement. The method determines whether a player is in an area of effects (27). A probability of kill is generated for the player (30). The player is assessed results of kill or near-miss (31–33). The method is repeated for a selected time duration (39).

20 Claims, 4 Drawing Sheets

METHOD FOR SIMULATING TEMPORAL ASPECTS OF AREA WEAPONS

BACKGROUND OF THE INVENTION

The present invention pertains to area weapons effects simulation systems and more particularly to the time-related properties of the weapons being simulated.

To date, distributed simulations of indirect fire such as artillery and mortars have not taken into account the duration of the simulated engagement. The term "distributed" is used here to specify systems in which the pairing of the weapon and the target and the resulting casualty assessment is performed on a battlefield site under attack rather than at a central processing site. Examples of existing distributed area weapons effects simulation (AWES) systems are the Combined Arms Training Integrated Evaluation System (CATIES) produced by Motorola and the Simulated Area Weapons Effects-Radio Frequency (SAWE-RF) system produced by Loral. These systems simulate artillery and mortar barrages as single events, having no duration. These systems do not correspond to the reality of the situation during actual artillery or mortar barrages, which may last for several minutes or tens of minutes By neglecting to simulate the duration of the weapon engagement, the existing systems can only simulate the attrition caused by area weapons. Not taking into account the duration of area weapons engagements produces a fundamental deficiency in that some of the most important aspects of certain types of area weapons such as artillery, mortars, and aerial bombardments are not recreated. Specifically, existing simulation systems which do not consider the temporal aspects of area weapons simulations are deficient in three areas. These areas are:

First, the suppressive effects of indirect fire and aerial bombardment are not replicated. Indirect fire such as artillery is commonly brought to bear on an opposing force to restrict the movement of an opposing force or to make the enemy take cover to limit their ability to return fire. When under bombardment, enemy soldiers are forced to hunker-down and can not effectively return fire without putting themselves at great risk. In order to produce equivalent effects, the AWES system must simulate the effects of the weapon over a period of time equivalent to that of the real weapon. If the duration of the engagement is zero, casualties can be assessed, but if the engagement has no duration, there can be no suppression of the enemy, other than through attrition.

Second, the area denial aspects of indirect fire are not replicated. When artillery or other indirect-fire weapons are fired against a location, the opposing force can not pass through that area without putting itself at risk. Therefore artillery fire is often used to prevent an enemy from entering a particular area. This area denial aspect of indirect fire is only effective while the bombardment is taking place. To reproduce this property of indirect fire, the simulation must reproduce the effects and related casualty assessments of the weapons over the time interval in which the simulated rounds are landing. If the simulation has zero duration, there can be no effective area denial, since once the casualties have been assessed, the area is perfectly safe.

Third, soldiers participating in training exercises have no opportunity to respond to area weapons or to adopt countermeasures. If simulated area weapon engagements have zero duration, the soldiers in training can not react to the start of the simulated engagement and adopt countermeasures which would be effective in preventing the soldier from becoming a casualty. Such countermeasures include taking cover, closing vehicle hatches, donning protective clothing, or simply moving. If the weapons engagement is simulated as a single event, the player has no time to react and all casualty assessments are based on the player's position, posture, and situation immediately prior to the start of the attack.

It would be desirable to have a method of simulating indirect fire and other area weapons which takes into account the duration of the engagement and allows weapon-target pairing and casualty assessment to be performed in the player units over a time interval which replicates the duration of the simulated weapon engagement while requiring only a single simulation transmission.

DESCRIPTION OF THE PREFERRED EMBODIMENTS

This invention is an improvement to the Area Weapons Effects System (AWES) for distributed casualty assessment process described in U.S. Pat. Nos. 4,744,761 and 4,682,953 by Doerfel, et al. Distributed casualty assessment means that the pairing of the weapon and the target and the determination of the resulting effect is performed at each individual target, or player, rather than at a central location. This technique is generally recognized as providing a higher degree of fidelity and realism than the alternative centralized approach. The present invention essentially adds the additional parameter of time to the simulation of area weapons effects.

Figure 1:
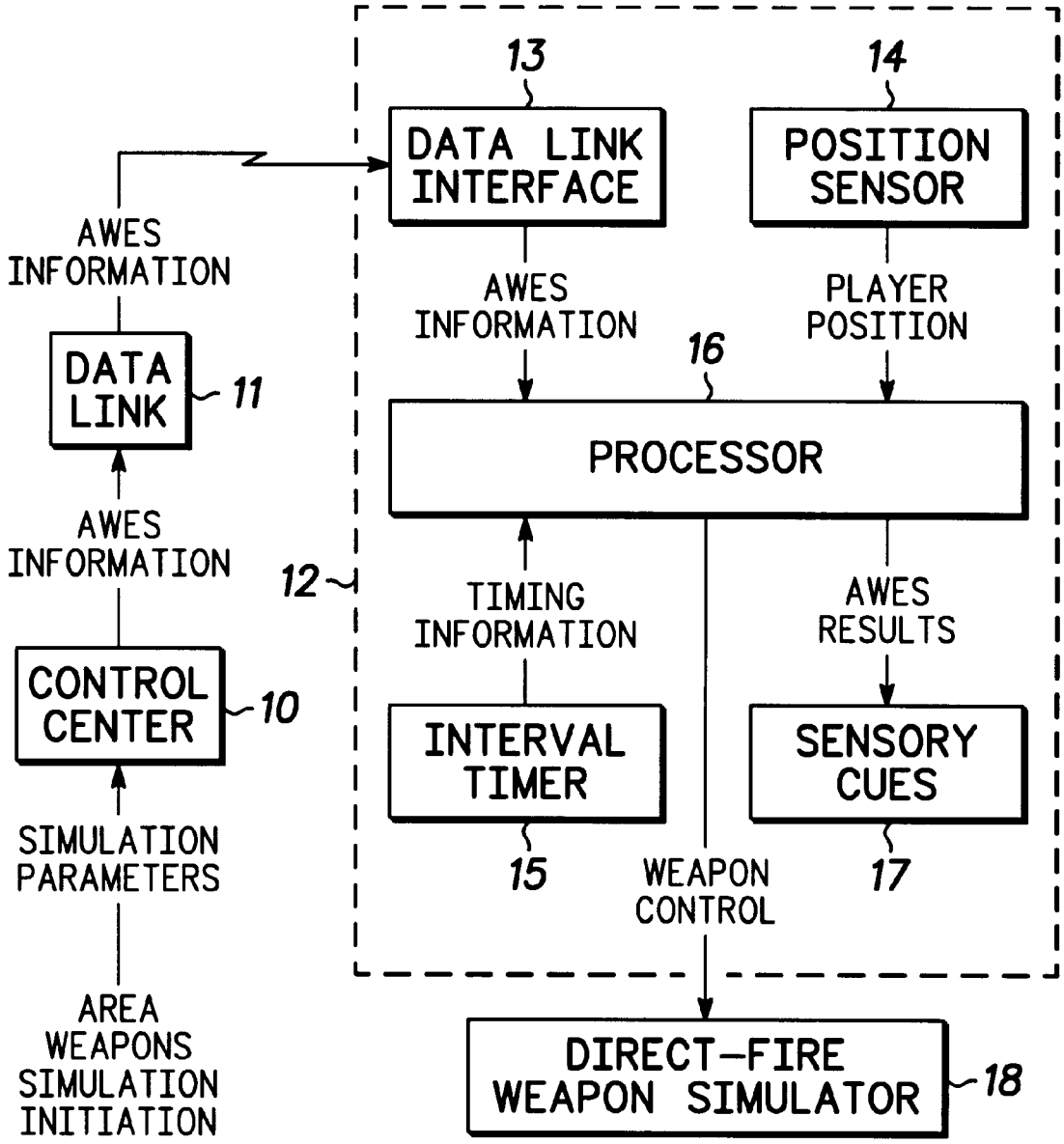
FIG. 1 is a block diagram of an area weapons effects simulation system in accordance with the present invention.

The architecture of an area weapons effects simulation system is shown in FIG. 1. Area weapons simulations are initiated at the Control Center 10. This initiation may be through either a manual entry by an operator at a computer workstation or through a digital message received from an automated fire control system, such as the US Army's TACFIRE system or the British BATES system, for example. The initiation defines the parameters of the simulation. These include, but are not limited to the weapon type, the munitions and fuzing, the location of the firing unit, the location of the target point, the number of guns firing, the pattern of fire, the time on target, the duration of the fire, and the variation in weight of fire over time. The Control Center 10 reformats the simulation parameters into an AWES message including the area weapons simulation information in a format suitable for transmission over the wireless Data Link 11 to the player units 12 (one of which is shown).

Each Player Unit 12 includes a Data Link Interface 13 which allows it to receive AWES messages sent from the Control Center 10 via the Data Link 11. The received AWES message is sent to the Processor 16. Each player unit 12 also includes a Positioning Sensor 14 which also interfaces to the Processor 16. This device is typically a Global Positioning System (GPS) receiver, but may be a multilateration-based positioning device or any other device capable of determining the position of the player. The Player Unit 12 further includes an Interval Timer 15 which provides the Processor 16 with the capability to measure increments of time. This may be a real-time clock, a free-running oscillator and counter, or any similar device capable of measuring time increments. The Processor 16 is coupled to Sensory Cues 17 whose purpose is to enunciate area weapons simulations and any resulting casualty assessments to players. These cues may include text or graphic displays, indicator lights, audio devices, pyrotechnic devices, or any other similar devices which can be used to convey the location and/or nature of simulated activity to players. The Processor 16 may also be interfaced to a Direct-Fire Weapon Simulator 18, allowing the Processor 16 to inhibit the firing of the player's offensive weapons when either a "Kill" has been assessed or when the AWES simulation would result in the suppression of the player's offensive capabilities.

Figure 2:
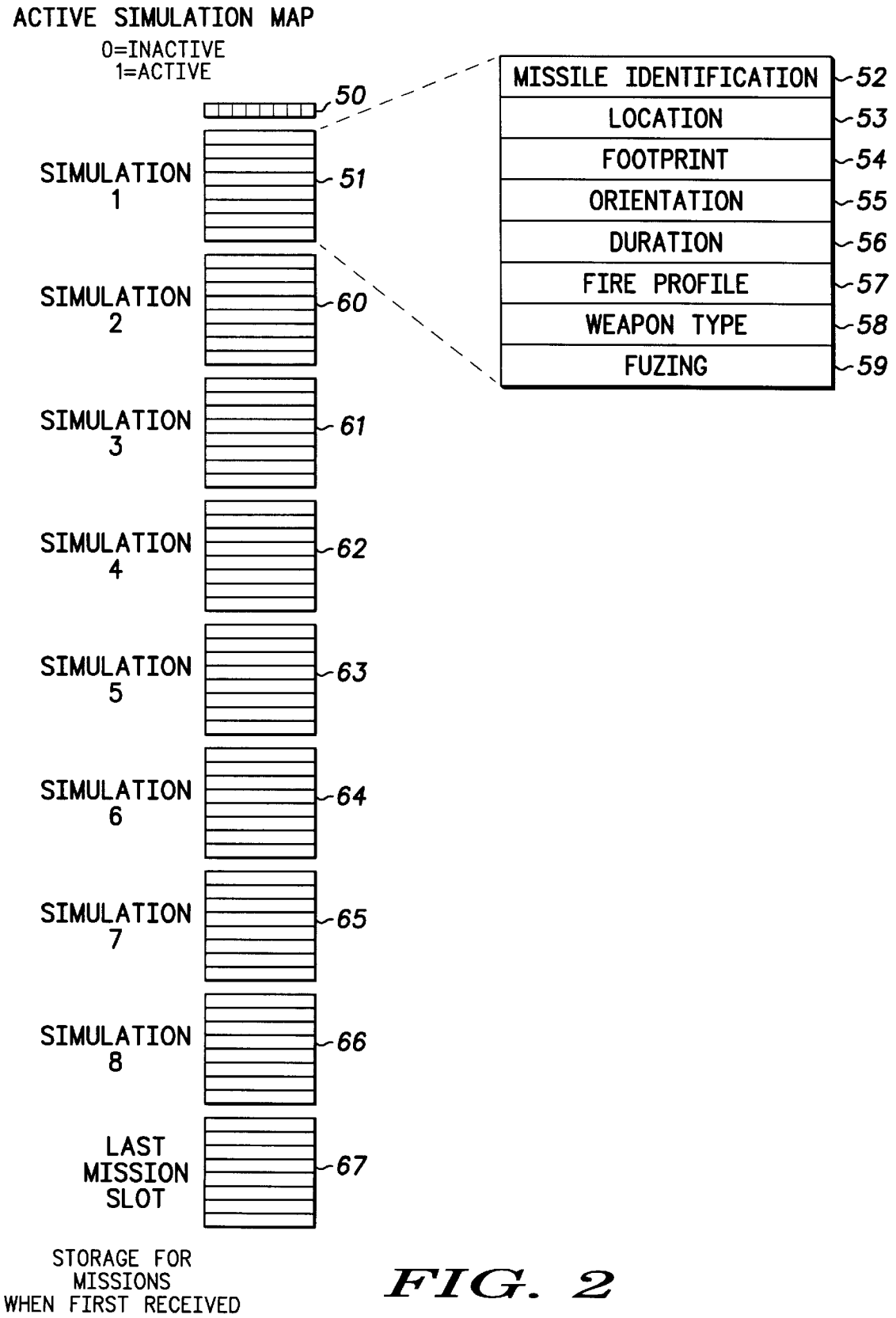
FIG. 2 is a memory map showing how area weapons effects mission parameters are stored in accordance with the present invention.
Figure 3:
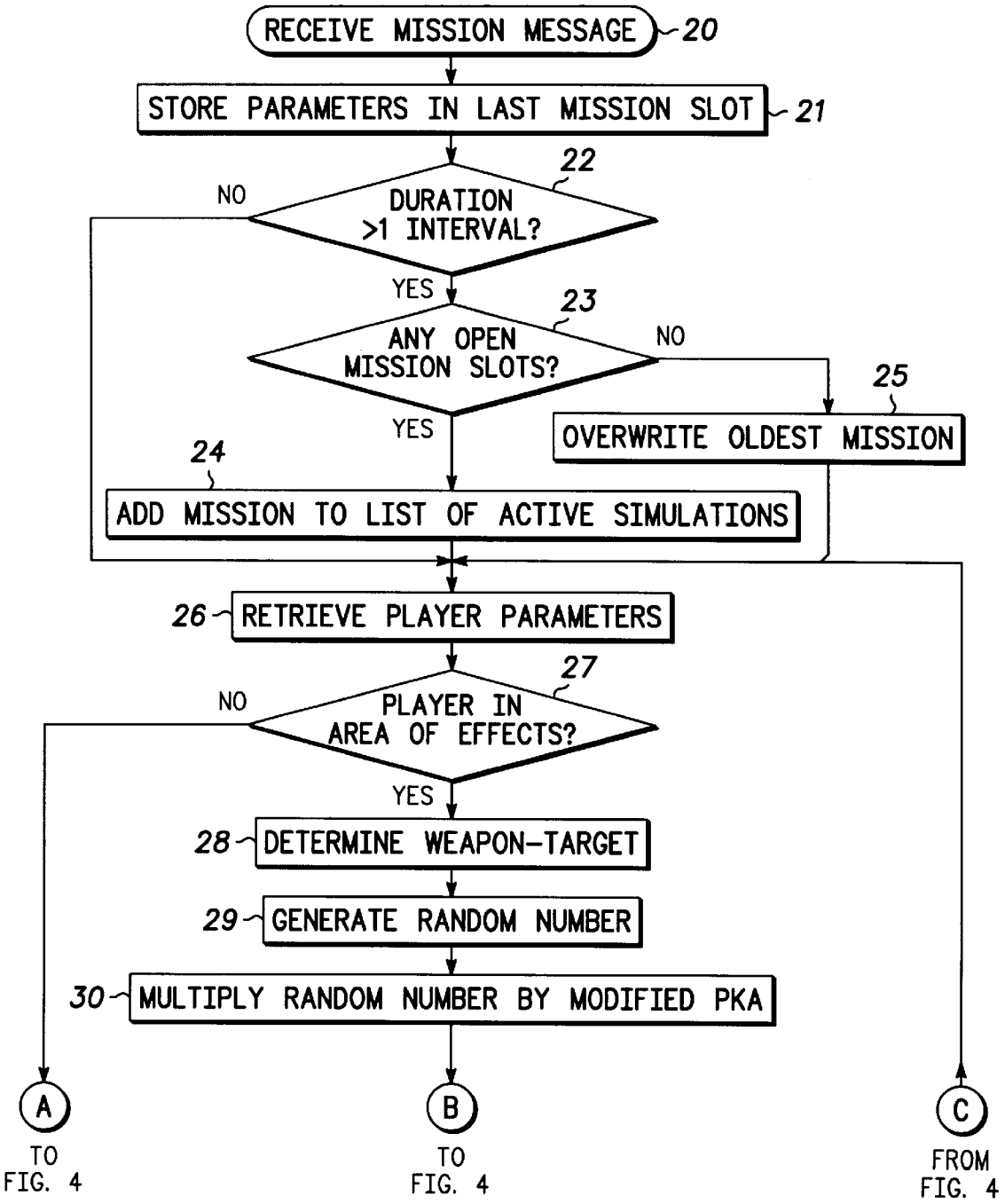
FIG. 3 is a flow chart of the processing of area weapons simulation information in the player units in accordance with the present invention.
Figure 4:
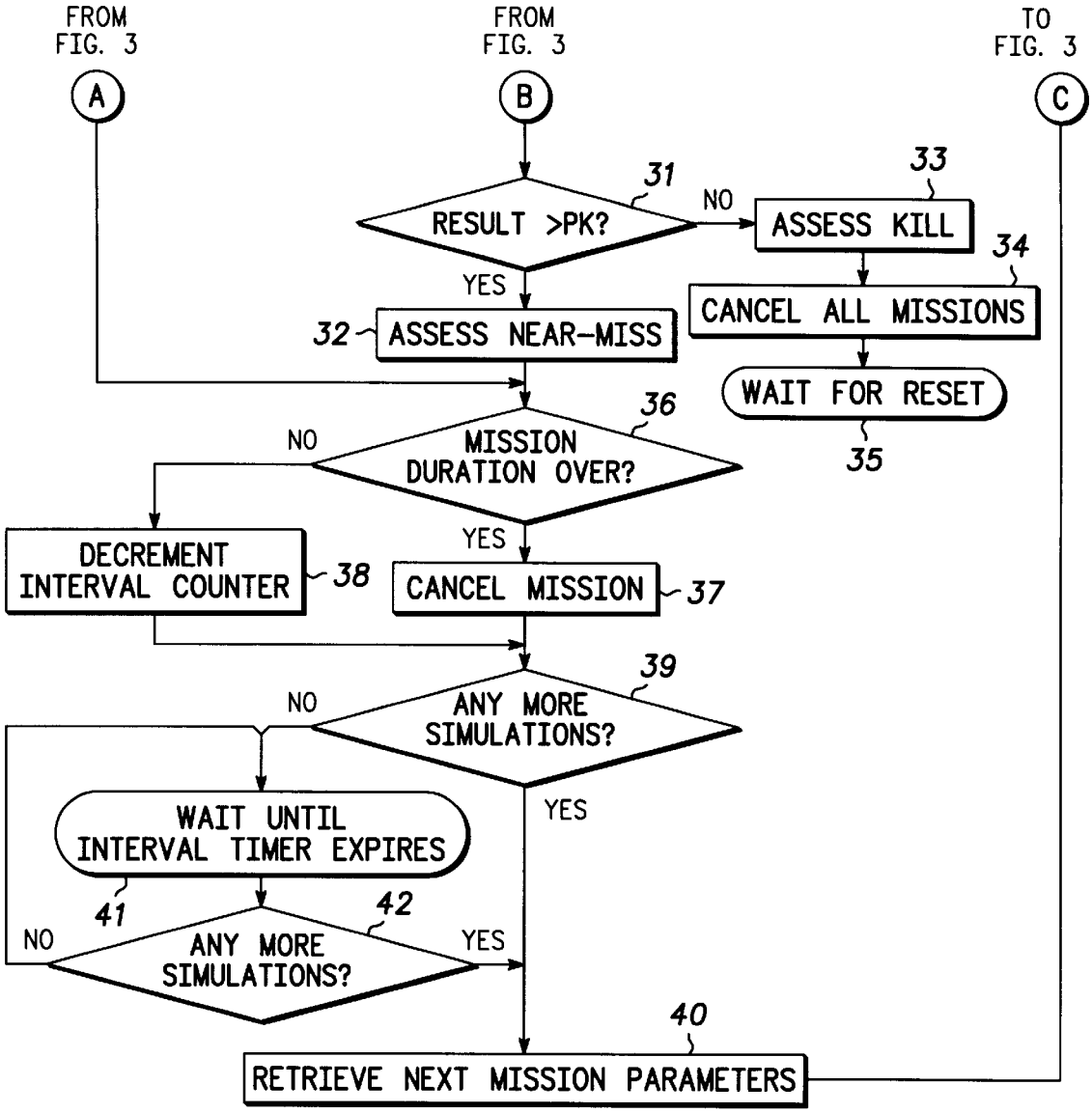

FIG. 2 is a memory map showing how area weapons simulation missions are stored in the player unit processor, item 16 in FIG. 1. Referring to FIGS. 3 and 4, the processor 16 maintains a map of the simulation storage spaces. This map 50 provides a means of indicating which storage element contains an active simulation.

In the example shown in FIG. 2, eight simulation storage elements are shown, however the number of storage elements may be varied to accommodate the particular application. These simulation storage elements are items numbered 51 and 60 through 67. Each simulation storage element 51 and 60–67 provides storage for one set of area weapons simulation parameters. These parameters include a Mission Identification Number 52, the location at which the simulated area weapons engagement is to occur 53, a "footprint" 54 which is a description of the size and shape of the area which is covered by the simulation, an angle of orientation 55 of the footprint 54 with respect to a fixed direction, typically North, the time interval or duration over which the simulation is to occur 56, an indication of the variation of the distribution of fire 57 over the simulation time period, the weapon type 58, and the fuzing 59.

Referring to FIGS. 1, 2, and 3 taken in combination, FIG. 3 is a flow chart of the processing for area weapons simulations performed in the processor 16 in the Player Unit 12 in FIG. 1. Prior to any area weapons simulations being received by the processor 16, the processor 16 will remain in the loop between steps 41 and 42. The processor 16 periodically receives a signal from the interval timer 15. Upon receipt of this signal, the processor 16 exits step 41 and enters step 42 during which it checks the map of active simulations 50 to determine if there are currently any active simulations stored in memory. Prior to any area weapons simulations having been received, no active simulations will be in memory and the process will return to step 41 to wait for the interval timer 15 to expire. This will continue until the first area weapon simulation is received. If in step 42 there are active simulations, the processing proceeds to step 40 in which the simulation parameters are retrieved and the processing moves to step 26.

When an area weapons simulation message is received by the processor 16 via the Data Link Interface 13, the processing jumps to step 20. When the message has been collected, the area weapons simulation information is stored in the last mission slot 67, which in this example is the last evaluated mission slot, in memory and the processing then proceeds to step 22 where the processor 16 checks the duration parameter 56 to determine if the duration of the simulation will be greater than one interval of the interval timer 15. If the duration of the simulation is only one interval, the processing skips to step 26. If the duration is more than one interval, the processing proceeds to step 23. In this step 23, the processor 16 checks the active simulation map 50 to determine whether there are any simulation storage elements which do not currently contain an active simulation. If a storage element, or "slot" is available, the processor 16 moves to step 24 and the simulation parameters received are stored in one of the open slots (51 and 61–67) and the processor 16 sets the corresponding bit in the active simulation map 50 to indicate that simulation storage element now contains an active simulation. The processing then proceeds to step 26. If in step 23, it was determined that every slot contained an active simulation, the processor 16 proceeds to step 25 and replaces the oldest active simulation with the received simulation information and the processor 16 proceeds to step 26.

Step 26 may be entered in one of three ways. First, this may occur as a result of a new simulation being received following storage of the area weapons simulation parameters in either step 24 or 25. Second, step 26 may be entered when the interval timer expires in step 41 and one or more active simulations are indicated in step 42 in which case, the mission parameters are retrieved in step 40 and the processing proceeds to step 26. Third, step 26 may be entered when one simulation has been completed and the processing checks for additional active simulations which are found in step 39 in which case the next mission parameters will be retrieved and the processing proceeds to step 26. In step 26, the processor 16 retrieves parameters relating to the player. These parameters include the player's present position as provided by the position sensor 14 in FIG. 1. Player parameters also include the player's type, that is whether the player is a soldier, a vehicle, an aircraft, a stationary object, the type of vehicle or any other information describing the nature of the player. Following retrieval of the player parameters, the processing proceeds to step 27.

In step 27, the position of the player is compared to the area covered by the simulation. This region, also known as the "area of effects" is a function of the location 53, the footprint 54 and the orientation 55 parameters of the area weapons simulation shown in FIG. 2. If the player's position is outside the area of effects, the player is unaffected by the simulation and the processing skips to step 36. If the player is within the area of effects, the processing proceeds to step 28.

In step 28, the processor 16 does a pairing of the weapon type 58 and fuzing 59 of the simulation parameters with the player type retrieved in step 26. This pairing may be through a simple look-up table arrangement or by an algorithm or any other mechanism which results in the generation of a probability of kill (Pk) of that weapon/fuzing against that type of player. If the weight of fire varies over the duration of the simulation, this is expressed in the fire profile parameter 57 which makes the probability of kill variable with time over the duration of the simulation.

Typically Pk is expressed as a number between zero and one. Following the generation of the Pk, the processor 16 proceeds to step 29 in which it generates a random number, again typically between zero and one. Following the generation of the random number, the processor 16 moves to step 30 and multiplies the random number by any adjustment factors (PKA) relevant to the simulation. These adjustment factors may be used to give the player credit for any countermeasures being taken by the player or any actions or postures of the player which would alter the nominal probability of kill. Examples of these adjustment factors are credit for wearing protective clothing or gas masks during chemical attack or adjustment factors to account for the player being dug-in during a mortar attack. One method of applying these adjustment factors is to multiply the random number by the adjustment factor. With this technique, adjustment factors greater than one will lower the probability that the player will be become a casualty, and factors less than one will increase the probability. The same results can be obtained by dividing the Pk by the adjustment factor. Following application of any relevant adjustment factors, the processing proceeds to step 31.

In step 31, the modified random number is compared to the Pk. If the number is greater than the Pk, the processing proceeds to step 32. If the number is less than or equal to the Pk, the processing proceeds to step 33 and the player is assessed a casualty, or "kill" and appropriate sensory cues 17 are activated and direct-fire capabilities of the player 18 are inhibited. Following assessment of a kill, all active misplans are canceled in step 34 and the player remains in step 35 waiting for a reset or re-activation.

Step 32 is reached when the player is within the area of effects of the area weapon, but has not been assessed a kill. This condition is called a "near-miss" When the player is assessed a near-miss in step 32, appropriate sensory cues 17 are activated to enunciate the engagement to the player and under certain conditions, nearby observers. Depending on the nature of the weapon and the type of target, the direct-fire offensive capabilities 18 of the player may also be temporarily inhibited. Following step 32, the processing proceeds to step 36.

Step 36 may be reached either from step 27 when the player's position is outside the area of effects or from step 32 when the player has been assessed a near-miss. In step 36, the processor 16 determines whether the duration of the simulation 56 has been completed. This may be done by examining a real-time clock or as in this example, by checking a count of the number of remaining simulation intervals. If the simulation has not been completed, the processing moves to step 38 in which the count of remaining simulation intervals is decremented. If in step 36 it was determined that the simulation duration was complete, step 37 is entered and the processor 16 cancels the mission by clearing the bit corresponding to that particular simulation in the active simulation map 50.

Step 39 is reached following processing of a previous simulation through either steps 37 or 38. In this step, the processor 16 checks the map of active simulations 50. If there are no more active simulations, the processor 16 then proceeds to step 41 to wait for the interval timer 15 to expire.

If one or more active simulations was found, the processor 16 proceeds to step 40 where it retrieves the relevant area weapons simulation parameters. If steps 26 through 36 were executed as the result of a new simulation being received, the simulation would have used the parameters in the last mission slot 67 and the duration of that simulation slot would be completed, resulting in step 37 to be executed and that mission slot to be canceled. Since no other simulation storage elements follow the Last Mission Slot, following that simulation the processing automatically proceeds to step 41 to wait for the interval timer to expire.

The above described invention provides the advantages of simulating indirect fire in a simulated battlefield situation while taking into account the time duration of the engagement. This invention as shown also provides for weapon-target pairing and casualty assessment for each of the battle participants of a time interval which more closely replicates a battlefield duration. This system also accounts for defensive measures taken by troops under attack.

Although the preferred embodiment of the invention has been illustrated, and that form described in detail, it will be readily apparent to those skilled in the art that various modifications may be made therein without departing from the spirit of the invention or from the scope of the appended claims.

I claim:

1. A method for simulating temporal aspects of area weapons effects systems by a processor, the method comprising the steps of:

determining whether a player is within an area covered by an area weapons effect simulation;

generating a probability of kill for the player based upon player parameters and upon simulation parameters;

assessing results on the player based on the probability of kill; and iterating the steps of determining, generating, and assessing, if a duration of the area weapons effect simulation is for more than one interval.

2. A method for simulating temporal aspects of area weapons effects systems as claimed in claim 1, wherein there is further included the steps of:

receiving by the processor a mission message; and storing the mission message in a last mission slot of a memory.

3. A method for simulating temporal aspects of area weapons effects systems as claimed in claim 2, wherein there is further included the steps of:

determining whether the mission message indicates a time duration greater than one time interval;

determining whether there are any available mission slots in the memory;

adding the mission message to a list of active simulations, if there are available mission slots; and overwriting an oldest mission message with the mission message, if there are no available mission slots.

4. A method for simulating temporal aspects of area weapons effects systems as claimed in claim 3, wherein there is further included the steps of:

retrieving the player parameters which describe the player;

said step of determining whether the player is within the area covered by the area weapons effect simulation including the steps of:

determining a weapon/target type, if the player is within the area covered by the area weapons effect simulation; and determining whether a duration of more than the one time interval is achieved.

5. A method for simulating temporal aspects of area weapons effects systems as claimed in claim 4, wherein the step of determining the weapon/target type includes the steps of:

reading a weapon type from the mission message;

reading a fuzing type from the mission message; and comparing the player parameters with the weapon type and the fuzing type to generate the probability of kill.

6. A method for simulating temporal aspects of area weapons effects systems as claimed in claim 5, wherein there is further included the step of generating a random number.

7. A method for simulating temporal aspects of area weapons effects systems as claimed in claim 6, wherein there is further included the steps of:

modifying the probability of kill to account for countermeasures taken by the player to produce an adjusted probability of kill; and multiplying the random number by the adjusted probability of kill.

8. A method for simulating temporal aspects of area weapons effects systems as claimed in claim 7, wherein there is further included the step of determining whether the adjusted probability of kill is greater than the probability of kill.

9. A method for simulating temporal aspects of area weapons effects systems as claimed in claim 8, wherein there is further included the steps of, if the adjusted probability of kill is less than or equal to the probability of kill:

assessing the player a casualty;

canceling all mission messages; and transmitting a message to the player to become inactive and wait for a reset.

10. A method for simulating temporal aspects of area weapons effects systems as claimed in claim 8, wherein there is further included the step of assessing the player a near-miss.

11. A method for simulating temporal aspects of area weapons effects systems as claimed in claim 8, wherein there is further included the step of determining whether the mission message indicates a duration greater than one interval of said area weapons effect simulation.

12. A method for simulating temporal aspects of area weapons effects systems as claimed in claim 11, wherein there is further included steps of:

reading the time duration from the mission message; and using the time duration from the mission message to determine whether the time duration is greater than one time interval.

13. A method for simulating temporal aspects of area weapons effects systems as claimed in claim 11, wherein there is further included steps of:

reading a fire profile from the mission message; and using the fire profile to vary determining the adjusted probability of kill.

14. A method for simulating temporal aspects of area weapons effects systems as claimed in claim 11, wherein there is further included a step of decrementing an interval counter, if the mission message indicates a time duration greater than one time interval.

15. A method for simulating temporal aspects of area weapons effects systems as claimed in claim 11, wherein there is further included a step of canceling the mission message, if the mission message indicates a duration of one interval.

16. A method for simulating temporal aspects of area weapons effects systems as claimed in claim 15, wherein there is further included the step of determining whether any of mission messages are active.

17. A method for simulating temporal aspects of area weapons effects systems as claimed in claim 16, wherein there is further included the steps of, if no mission messages are active:

waiting until an interval timer expires;

determining whether any of mission messages are active;

retrieving a next active mission message, if any mission message is active; and iterating the steps of claims 3 through 16, if any mission message is active.

18. A method for simulating temporal aspects of area weapons effects systems as claimed in claim 16, wherein there is further included the steps of, if any mission messages is active:

retrieving a next active mission message; and iterating the steps of claims 3 through 16.

19. In a battlefield simulation, a method for simulating temporal aspects of area weapons effects systems, the method controlled by a processor and comprising the steps of:

determining whether a player is within an area covered by an area weapons effect simulation;

generating a probability of kill for the player based upon player parameters and upon simulation parameters;

assessing results on the player based on the probability of kill and on countermeasures taken by the player; and iterating the steps of determining, generating, and assessing, if a duration of the area weapons effect simulation is for more than one interval.

20. In a battlefield simulation, a method for simulating temporal aspects of area weapons effects systems, the method controlled by a processor and comprising the steps of:

receiving by the processor a mission message;

determining whether a player is within an area covered by an area weapons effect simulation;

generating a probability of kill for the player based upon player parameters and upon simulation parameters;

assessing results on the player based on the probability of kill and on countermeasures taken by the player; and iterating the steps of determining, generating, and assessing, if a duration of the area weapons effect simulation is for more than one interval.

* * * * *